US006248414B1

(12) United States Patent
Donahue

(10) Patent No.: US 6,248,414 B1
(45) Date of Patent: Jun. 19, 2001

(54) UNITARY STACK OF REPOSITIONAL PAPER SHEETS

(75) Inventor: P. Richard Donahue, Naples, FL (US)

(73) Assignee: P. R. Donahue Incorporated, Naples, FL (US)

( * ) Notice: Subject to any disclaimer, the term of this patent is extended or adjusted under 35 U.S.C. 154(b) by 0 days.

(21) Appl. No.: 09/168,239

(22) Filed: Oct. 8, 1998

(51) Int. Cl.[7] ..... B42D 5/00

(52) U.S. Cl. ..... 428/41.8; 24/67 R; 24/67 AR; 281/21.1; 412/37; 412/38; 412/901; 428/40.1; 428/40.2; 428/42.1; 428/194; 428/211; 428/214; 428/354

(58) Field of Search ..... 428/40.1, 40.2, 428/41.8, 42.1, 194, 211, 214, 354; 24/67 R, 67 AR; 412/37, 38, 901; 281/21.1

(56) References Cited

U.S. PATENT DOCUMENTS 5,202,169 * 4/1993 Spendlove ..... 428/43
5,766,401 6/1998 Campbell et al. ..... 156/277
5,965,225 * 10/1999 Torres ..... 428/43

* cited by examiner

*Primary Examiner*—Nasser Ahmad
(74) *Attorney, Agent, or Firm*—Charles R. Wilson

(57) ABSTRACT

A unitary stack of paper sheets has alternating individual paper sheets and individual release liners which are loosely bonded together in a manner whereby an individual paper sheet is easily removed and used as a base. Each paper sheet in the unitary stack has a pressure sensitive adhesive partially covering each face thereof in approximate aligned areas of the respective faces. A back face of the individual sheet is adhered to a substrate while a front face holds an item for posting. In use, an individual paper sheet is readily removed from the unitary stack, adhered on its back face to the substrate, and then an item posted on its front face.

17 Claims, 2 Drawing Sheets

UNITARY STACK OF REPOSITIONAL PAPER SHEETS

FIELD OF THE INVENTION

This invention relates to a unitary stack of paper sheets. More particularly, the invention relates to a unitary stack of paper sheets whereby each individual paper sheet is readily removed from the stack and used for item posting purposes.

BACKGROUND OF THE INVENTION

Many people are in the habit of posting notes, appointment cards, children's artwork, messages, grocery lists, emergency telephone numbers, invitations and other informational-type items in a central home or office location. Bulletin boards, of course, have long been used for posting items. Thumb tacks or some needle-like tipped implement is used to hold the items, normally printed paper items, to the bulletin board. The homeowner may use a refrigerator door or other appliance with a large metallic surface area for temporarily holding the items. Thin magnets, commonly referred to as refrigerator magnets, are widely used. Adhesive tape can also be used to tape edges or corners of the item to the substrate. A double sided tape is also occasionally used. Such means of posting an item for later referencing are convenient, though can be somewhat cumbersome to use.

A substantial number of homes do not have a bulletin board for posting purposes or a kitchen appliance with a metallic substrate. In fact, many modern appliances have non-metallic surface panels which do not interact with magnets. Posting of light-weight items is more difficult in such homes. Articles produced to fill the known need include mark and wipe boards and dry erase boards.

In accord with a need, there has been developed a unitary stack of paper sheets, each sheet of which can be used to form a base for adhering an item thereto. The unitary stack is economical to produce, its use is easily understood, and the individual paper sheets are reliable for their intended purpose.

SUMMARY OF THE INVENTION

A unitary stack of paper sheets has sheets loosely bonded together in a manner whereby the stack maintains its integrity during storage and use, yet permits each individual paper sheet in the stack to be readily removed. The stack comprises alternating paper sheets and release liners. Each paper sheet has a front face and a back face. A pressure sensitive acrylic adhesive partially covers each face of each individual sheet in approximate aligned areas thereof. The acrylic adhesive is in the form of microspheres with an about 0.4 mils to about 0.8 mils thickness to obtain the proper adhesive strength for the intended purposes. The pressure sensitive adhesive on the back face of the paper sheet allows the paper sheet to be adhered to a substrate. The pressure sensitive adhesive on the front face of the paper sheet is to receive and hold an item for posting. The release liners facilitate removal of the individual paper sheets from the unitary stack.

DETAILED DESCRIPTION OF THE INVENTION

The unitary stack of individual paper sheets of the invention is particularly useful in a home setting and in an office setting. It is, for this reason, described in these settings in the following paragraphs. It can as well be used in an industrial setting or wherever there is a need to temporarily post a light-weight item for referencing purposes.

Figure 1:
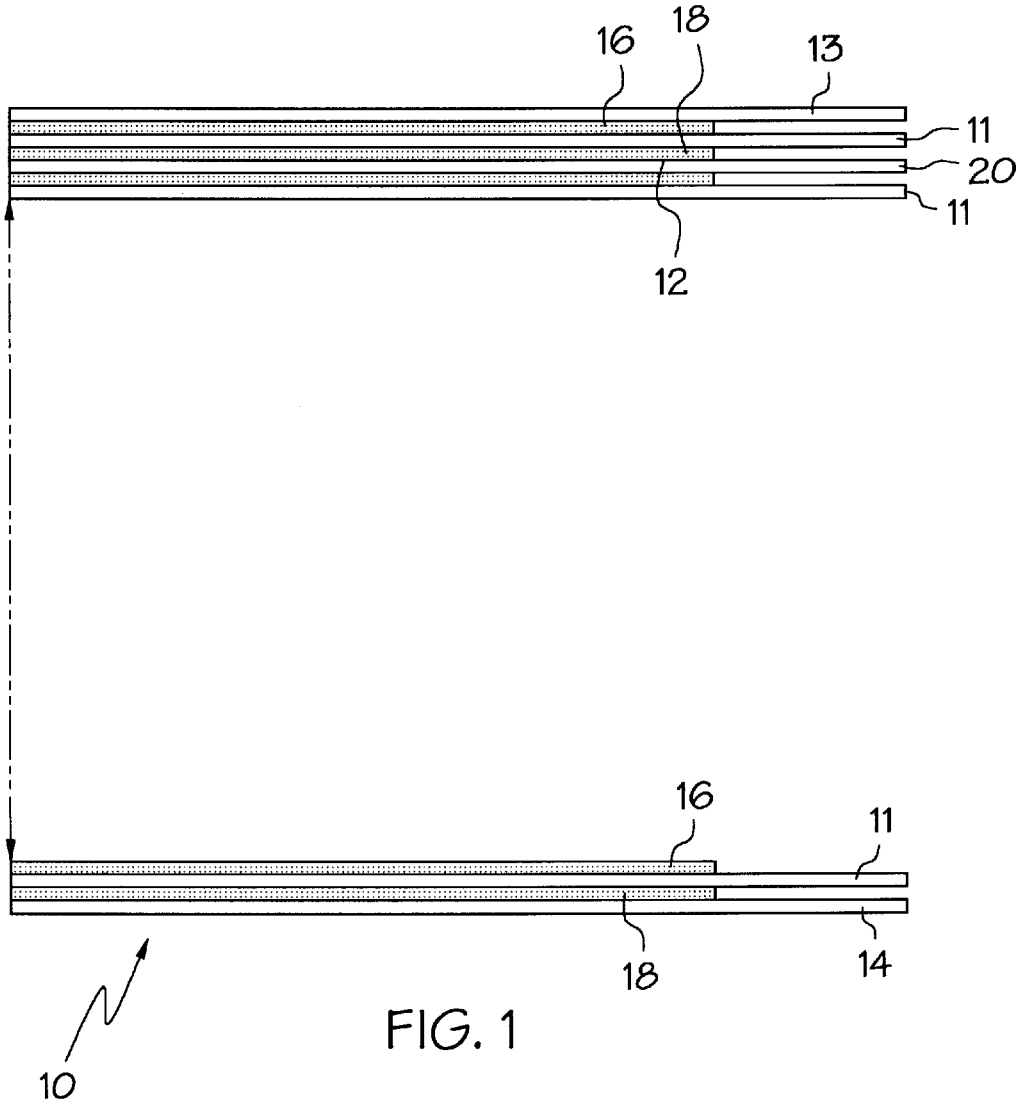
FIG. 1 is a side view of a unitary stack of paper sheets of the invention.

With reference to FIG. 1, there is shown a unitary stack 10 of the invention. The stack 10 is comprised of a plurality of individual uniformly shaped paper sheets 11 and release liners 12 loosely bonded together sufficiently to maintain the integrity of the stack. The paper sheets 11 and release liners 12 alternate in the unitary stack as discussed in more detail in the following paragraphs. Preferably, removable release covers 13 and 14 are included on top and bottom of the stack for packing reasons. The top release cover is removed and discarded when the unitary stack 10 is initially unpackaged for use. The bottom release cover 14 normally remains in place until the unitary stack is of its individual paper sheets.

Figure 3:
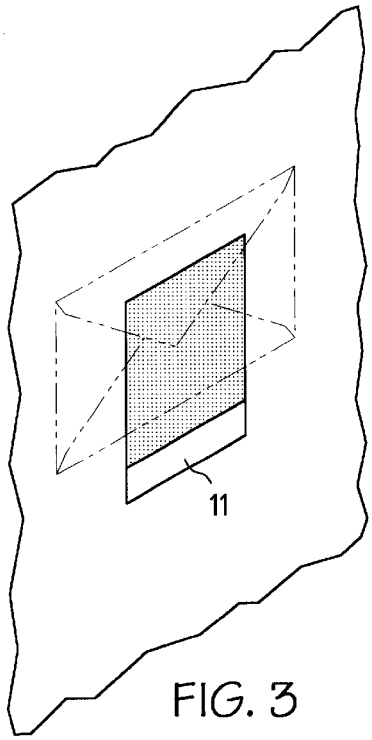
FIG. 3 is an environmental view of an individual paper sheet of the unitary stack of FIG. 1 adhered to a substantially vertical wall substrate with an envelope temporarily adhered thereto for posting purposes.
Figure 2:
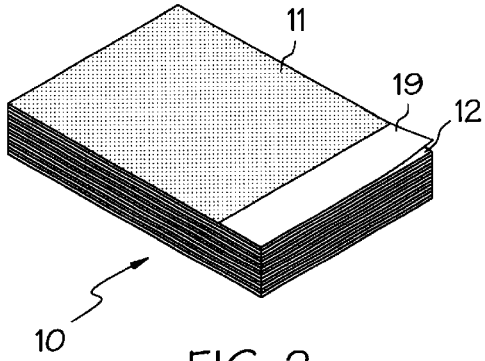
FIG. 2 is a perspective view of the unitary stack of paper sheets of FIG. 1 with a top release cover removed.

The number of individual paper sheets in a stack can vary widely. For practical purposes, each unitary stack has at least about 10 individual paper sheets. Preferably, from about 10 paper sheets to about 100 paper sheets form a unitary stack. As seen in FIG. 3, one of the individual paper sheets 11 is adhered to a substantially vertical substrate and has an envelope (shown in phantom) adhered to it.

Figure 4:
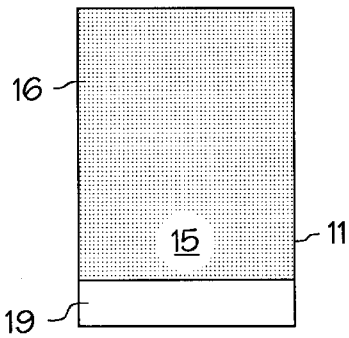
FIG. 4 is a top plan view of an individual paper sheet taken from the unitary stack of FIG. 1.
Figure 5:
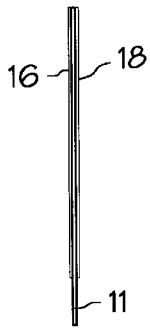
FIG. 5 is an end view of the individual paper sheet of FIG. 4.
Figure 6:
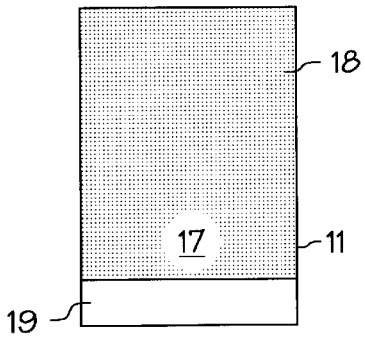
FIG. 6 is a bottom plan view of the individual paper sheet of FIG. 4.

As best seen in FIGS. 4–6, an individual paper sheet 11 taken from the unitary stack 10 has a front face 15 with an adhesive 16 partially covering it and a back face 17 with an adhesive 18 partially covering it. The size and shape of the individual sheets are not critical. For manufacturing and packaging purposes, the individual sheets and hence the unitary stack is preferably rectangular-shaped or square-shaped. Each paper sheet 11 ranges from about one-fourth inch to about six inches in width and about one inch to about five inches in length. A preferred paper sheet ranges from about one-fourth inch to about one inch in width and about one inch to about three inches in length. The narrow width of the preferred paper sheet is feasible because of the adhesive used in the invention. Paper sheets with the narrow width are preferred due to reduced manufacturing costs, enhanced ease of use by the consumer, and desired inconspicuous product use. Larger sized paper sheets are feasible dependent on the intended use and are contemplated in this invention. Such larger sized paper sheets, though, tend to be for very specialized uses as found in an industrial setting.

The adhesives 16 and 18 on the individual paper sheets 11 partially cover the respective front face 15 and back face 17 thereof. It is important for the adhesive to not fully cover the faces in that the individual sheets are then more difficult to grasp and remove from the stack during use. The adhesives 16 and 18 are positioned on approximate aligned areas of the respective faces of the paper sheets 11.

Preferably, each adhesive on the paper sheets extends fully across the width of the faces. Preferably, each adhesive also extends down from a top edge to about 70% to about 95% of the sheet's length, more preferably from about 80% to about 90% of the sheet's length. This results in an adhesive-free area 19 of about one-quarter inch to about three-quarters inch at the bottom of the sheet on both sides as a handle for grasping purposes. It has been found the preferred adhesive placement optimizes removal of individual sheets from the unitary stack and actual use of the individual sheets. Paper sheets which are fully covered on both sides by an adhesive are difficult to individually grasp and remove from the unitary stack. Conversely, too small of an adhesive area will adversely affect the ability of the individual sheet to adhere to a substrate and/or to adequately hold an item to be posted.

Commercially available pressure sensitive acrylic adhesives are used in the invention. The adhesive must have a degree of adhesion sufficient to stick to a substrate and an item to be posted, yet be releasable. Additionally, the adhesive must not leave a sticky residue. Adhesives found to have the proper degree of adhesion for the purposes contemplated in this invention are water-based acrylic adhesives which are applied as microspheres onto the paper sheets. The adhesive is applied at a level to give a dried adhesive of from about 0.4 mil to about 0.8 mil, preferably about 0.6 mil in thickness. Application of the adhesive as microspheres on properly sized paper is done by conventional well known methods.

The acrylic adhesive when applied as microspheres and at the proper thickness results in a degree of adhesion of from about 100 grams to about 150 grams per linear inch, preferably about 125 grams to about 135 grams per linear inch using test criteria published by the Pressure Sensitive Test Council (PSTC-1). It is theorized that the proper degree of adhesion results from the form of the adhesive, i.e. microspheres as opposed to a coalesced film, and proper thickness of adhesive, i.e. about 0.4 mils to about 0.8 mils.

The unitary stack 10 also includes the release liners 12 between each of the paper sheets 11. The release liners aid in removal of a single paper sheet 11 from the stack. Preferably, for appearance and performance purposes, each release liner 12 is approximately the same size and shape as the paper sheets 11. As evident in FIG. 1, when the release liner 12 is the same size as the paper sheet 11, a free edge 20 on each release liner 12 extends away from the adhesive areas of the paper sheet 11. The free edge 20 is available for grasping and facilitates removal of an individual paper sheet.

Release liners of various natures are commercially available and are used in the invention. For example, the release liners can be a wax coated paper sheet, silicone-coated paper sheet, or a plastic sheet such as a polyethylene terephthalate (available as Mylar sheet) or any other plastic sheet made from synthetic polymeric resin with non-stick physical characteristics. Highly preferred release liners are made from supercalendered kraft paper which has been silicone coated on both sides.

In use, the home owner or office worker who desires to post an item simply grasps an individual paper sheet from the unitary stack and pulls it therefrom. The sheet is then placed on a substrate in a convenient location. It can be used as is by writing on it, though in accord with the invention, an item to be posted is placed in contact with the adhesive strip on the front face of the paper sheet. It remains there for an indefinite time. In due course, the individual removes the item and reuses the paper sheet or simply removes and discards it. Whenever another paper sheet is needed, the home owner of office worker simply removes and discards the release liner underlying the first paper sheet to expose the next paper sheet. That paper sheet is removed from the stack as used as described about with respect to the first paper sheet.

Having described the invention in its preferred embodiment, it should be clear that modifications can be made without departing from the spirit of the invention. It is not intended that the words used to describe the invention nor the drawings illustrating the same be limiting on the invention. It is intended that the invention only be limited by the scope of the appended claims.

I claim:

1. A unitary stack comprised of at least about 10 equi-sized paper sheets and alternating release liners loosely bonded together in a manner to maintain the integrity of the stack and to facilitate the individual removal of each paper sheet from the stack for adhering to a substrate so as to provide a base for temporarily posting an item, each said paper sheet having a front face and a back face with an adhesive partially covering each said face in approximate aligned areas of the respective faces and further wherein each of said release liners is a double-sided silicone coated paper sheet and is positioned between two of said equi-sized paper sheets, whereby each said equi-sized paper sheet is readily grasped for removal from the stack and adhered to the substrate.

2. The unitary stack of claim 1 wherein the adhesive is a pressure sensitive adhesive.

3. The unitary stack of claim 2 wherein each equi-sized paper sheet in the stack ranges from about one-fourth inch to about six inches in width and about one inch to about five inches in length.

4. The unitary stack of claim 3 wherein each equi-sized paper sheet in the stack ranges from about one-fourth inch to about one inch in width and about one inch to about three inches in length.

5. The unitary stack of claim 3 wherein each equi-sized paper sheet in the stack is rectangular-shaped.

6. The unitary stack of claim 3 wherein each equi-sized paper sheet in the stack has the pressure sensitive adhesive extending substantially fully across the width of the sheet on the front face and on the back face thereof.

7. The unitary stack of claim 6 wherein the adhesives extend from a top edge of the equi-sized paper sheet to about 70% to about 95% the length of the equi-sized paper sheet.

8. The unitary stack of claim 7 wherein the adhesive is an acrylic adhesive in the form of microspheres.

9. The unitary stack of claim 8 wherein the adhesive has a thickness of from about 0.4 mils to about 0.8 mils on each side of the equi-sized paper sheet.

10. The unitary stack of claim 9 wherein the stack contains from about 10 equi-sized paper sheets to about 100 equi-sized paper sheets.

11. A unitary stack comprised of a top release cover, a bottom release cover and positioned between said top release cover and bottom release cover a plurality of individual uniformly shaped paper sheets and release liners loosely held together so as to maintain the integrity of the stack yet allow each individual uniformly shaped paper sheet thereof to be readily removed therefrom to adhere to a substrate for temporarily posting an item thereon, each said uniformly shaped paper sheet ranging from about one-fourth inch to about one inch in width and about one inch to about three inches in length and having a front face and a back face with from about 0.4 mils to about 0.8 mils of a pressure sensitive acrylic adhesive in the form of microspheres partially covering each said face in approximate aligned areas of the respective faces, each said release liner being a double-sided silicone coated paper sheet and having non-stick surfaces and each said release liner being positioned between two uniformly shaped paper sheets so that said uniformly shaped paper sheets are never in contact with one another whereby each uniformly shaped paper sheet is readily grasped for removal from the stack and adhered to the substrate.

12. The unitary stack of claim 11 wherein each of the adhesive strips on each uniformly shaped paper sheet extends from a top of the uniformly shaped paper sheet to about 70% to about 95% the length of the uniformly shaped paper sheet.

13. The unitary stack of claim 12, wherein the stack contains at least about 10 uniformly shaped paper sheets.

14. A unitary stack of repositional double sided adhesive covered paper sheets for repeated individual paper sheet grasping and removing from the unitary stack while maintaining integrity of the unitary stack, comprising:

(a) a bottom release cover;

(b) a lowermost repositional paper sheet positioned on the bottom release cover, said lowermost repositional paper sheet having a front face and a back face with (i) an adhesive partially covered area on each said face extending from a top edge of the lowermost repositional sheet to about 70% to about 95% the length of the lowermost repositional paper sheet and (ii) an adhesive-free area on each said face in approximate aligned areas for easy grasping;

(c) a lowermost double-sided silicone coated paper sheet release liner positioned on the lowermost repositional paper sheet for aiding in removal of the lowermost repositional paper sheet from the unitary stack;

(d) a plurality of (1) additional repositional paper sheets having a front face and a back face with (i) an adhesive partially covering each said face in approximate aligned areas extending from a top edge of the repositional sheet to about 70% to about 95% the length of the repositional paper sheet and (ii) an adhesive-free area on each said face in approximate aligned areas and (2) additional double-sided silicone coated paper sheet release liners wherein the additional repositional sheets and the additional double-sided silicone coated paper sheet release liners are positioned on said lowermost release liner and further wherein each said additional repositional paper sheet and each said additional double-sided silicone coated paper sheet release liner alternate such that one of said additional double-sided silicone coated paper sheet release liners is positioned between two of said additional repositional paper sheets and said additional repositional paper sheets are never in contact with one another;

(e) an uppermost repositional paper sheet positioned on the uppermost of the additional double-sided silicone coated paper sheet release liners, said uppermost repositional sheet having a front face and a back face with (i) an adhesive partially covered area of each said face extending from a top edge of the uppermost repositional sheet to about 70% to about 95% the length of the uppermost repositional paper sheet and (ii) an adhesive-free area on each said face in approximate aligned areas for easy grasping; and (f) a top release cover positioned on the uppermost repositional paper sheet, whereby the bottom release cover, the lowermost repositional paper sheet, the lowermost double-sided silicone coated paper sheet release liner, the plurality of additional repositional paper sheets and additional double-sided silicone coated paper sheet release liners, the uppermost repositional paper sheet and the top release cover are loosely bonded together to form the unitary stack and further whereby each repositional paper sheet is readily grasped on its adhesive-free area for removal from the unitary stack and individually used whereby one face adheres to a substrate and an opposed face receives an item for posting.

15. The unitary stack of repositional double sided adhesive covered paper sheets of claim 14 wherein each repositional paper sheet in the stack ranges from about one-fourth inch to about six inches in width and about one inch to about five inches in length.

16. The unitary stack of repositional double sided adhesive covered paper sheets of claim 15 wherein the adhesive-free area on each face of each repositional paper sheet extends to a bottom edge.

17. The unitary stack of repositional double sided adhesive covered paper sheets of claim 14 wherein the bottom release cover, the lowermost repositional paper sheet, the lowermost double-sided silicone coated paper sheet release liner, the additional repositional paper sheets, the additional double-sided silicone coated paper sheet release liners, the uppermost repositional paper sheet and the top release cover are all equi-sized.

* * * * *